United States Patent [19]

Mattis

[11] Patent Number: 4,498,726

[45] Date of Patent: Feb. 12, 1985

[54] CONNECTOR RECEPTACLE FOR ELECTRIC CIGAR LIGHTER

[75] Inventor: Donald J. Mattis, Norwalk, Conn.

[73] Assignee: Sun Chemical Corporation, New York, N.Y.

[21] Appl. No.: 561,159

[22] Filed: Dec. 14, 1983

[51] Int. Cl.[3] ..... H01R 13/50

[52] U.S. Cl. ..... 339/182 R; 339/218 M

[58] Field of Search ..... 339/177, 182, 183, 154 R, 339/91 R

[56] References Cited

U.S. PATENT DOCUMENTS

| | | | |
|---|---|---|---|
| 2,170,131 | 8/1939 | Doremus | 339/183 |
| 2,477,013 | 7/1949 | Spencer et al. | 339/182 R |
| 3,309,598 | 3/1967 | Montgomery et al. | 339/182 R |
| 4,011,000 | 3/1977 | Wharton | 339/182 R |
| 4,054,352 | 10/1977 | Rudin | 339/91 R |
| 4,368,941 | 1/1983 | Martin | 339/183 |

FOREIGN PATENT DOCUMENTS

| | | | |
|---|---|---|---|
| 1094840 | 12/1960 | Fed. Rep. of Germany | 339/154 R |

*Primary Examiner*—Joseph H. McGlynn
*Assistant Examiner*—David L. Pirlot
*Attorney, Agent, or Firm*—Cynthia Berlow

[57] ABSTRACT

An electrical connector receptacle for an automotive electric cigar lighter of the type having at its rear, a socket with a central terminal post and an annular electrically-conductive current-carrying sleeve. The receptacle comprises a slab-like body of molded insulating material having opposite grip surfaces to facilitate its installation, and having a generally U-shaped configuration. Between the two legs of the body is a space which provides clearance for the annular sleeve, one leg having a recess that carries a tubular contact terminal adapted to slip over the central terminal post of the socket, this being the "hot" side of the circuit. The other, outer leg constituting the ground side of the circuit, carries a spring contact finger having a bowed configuration with its center portion being cooperable with and juxtaposed to the sleeve of the socket, so as to having electrical connection thereto when the connector receptacle is installed. The spring contact finger and the tubular contact terminal of the center leg are generally coextensive with one another, and the force of the sleeve acting against the contact finger is balanced by a counteracting force of the central post of the socket on the tubular contact so as to maintain adequate pressure between the contact finger and sleeve. The result is an especially compact and reliable receptacle which can be quickly installed or released and which is capable of handling the relatively heavy electrical current normally associated with cigar lighter devices.

16 Claims, 13 Drawing Figures

CONNECTOR RECEPTACLE FOR ELECTRIC CIGAR LIGHTER

BACKGROUND

This invention relates generally to electric cigar lighter devices, and more particularly to electrical connector receptacles for such devices, by which the energizing current is brought to the cigar lighter socket.

In the past a number of different arrangements have been proposed and produced for effecting the electrical connection to the sockets of cigar lighters. As a rule such devices employ a centrally disposed stud at the rear of the socket, this terminal constituting the "hot" side of the lighter circuit. Connection to the other or ground side was made in a variety of ways. In early model vehicles where such lighters were mounted on metal dashboards, the bezel of the socket was in electrical contact with the walls of the mounting hole, with the dashboard being at electric ground potential. Generally such sockets carried tubular clamping shells which engaged the rear surface of the dash, thus providing both a mechanical mounting for the socket as well as an additional electrical path for the current being drawn.

With the advent of newer model vehicles, widespread use of plastic panels has evolved. Under circumstances where the mounting panel for the lighter is not metal, it is necessary to run a separate lead to the ground side of the lighter socket. This has been accomplished in many cases by means of a spade lug welded to the clamping shell of the socket, and a cooperable, separable push-on type space terminal connected to the vehicle ground. Such an arrangement has performed well over the past 10 years or so, and has won relatively wide acceptance in the industry. Generally the length of the lead extending from the push-on terminal to the vehicle ground or chassis was relatively short, frequently being on the order of a foot or less. The only requirement was that the other end of the lead be fastened to a sheet metal part of the vehicle by a suitable fastener such as a self tapping screw, etc.

There are, however, several disadvantages with the arrangement described above. The area around the lighter was sometimes not readily accessible, and installation or replacement of the push-on spade terminal was difficult or awkward. In addition, there existed a possibility of such push-on terminals loosening somewhat after repeated installations, or being subject to damage, if forced. Also, these terminals were susceptible of being inadvertently "sprung", resulting in poor mechanical and electrical contact. Problems also occurred involving corrosion of the spade lug, especially after an extended period of time, thus jeopardizing the integrity of the connnection.

Added to the above disadvantages was the extra cost of welding a spade lug onto the clamping shell for the socket. This necessitated replating of the area surrounding the weld, in order to avoid undesirable corrosion and also to maintain a clean, finished appearance.

Finally, there existed the possibility of the lead carrying the push-on spade terminal inadvertently loosening, or being left off entirely, thus leaving the ground side of the circuit floating and rendering the lighter inoperative.

SUMMARY

The above disadvantages and drawbacks of prior connector receptacles for electric cigar lighers are largely obviated by the present invention, one object of which is to provide a novel and improved connector receptacle that is extremely simple in construction while at the same time providing a reliable and virtually foolproof connection to the socket of the lighter.

A related object of the invention is to provide an improved connector receptacle as above set forth, wherein assembly of the receptacle can be quickly and easily effected, particularly without the use of special fixtures or tools.

Still another object of the invention is to provide an improved connector receptacle as above characterized, which is especially well adapted for use in locations of limited access, or where space is restricted.

Yet another object of the invention is to provide an improved connector receptacle of the kind indicated, wherein the there is minimized the likelihood of one or both leads to the socket being inadvertently left disconnected, or accidentally pulled off, either during installation, or following maintenance, replacement, etc.

A still further object of the invention is to provide an improved connector receptacle as outlined above, wherein some of the parts can be readily fabricated as simple metal stampings, and thereafter such stampings embedded in a molded receptacle body, to the end that the manufacturing cost is minimized to the greatest possible extent.

The above objects are accomplished, in one embodiment, by a dual-contact electrical connector receptacle for bringing current to an electric cigar lighter of the type comprising an ignitor-plug receiving socket having at its inner end an annular electrically-conductive current-carrying sleeve and a central post connected to the "hot" side of the cigar lighter circuit, said receptacle comprising a non-tubular, slab-like body of molded insulation exhibiting a pair of expansive, opposite, exteriorly exposed grip surfaces to facilitate manual engagement by an installer. The slab-like body comprises a U-shaped portion having two legs and a connecting yoke, and the space between the legs provides clearance for the annular sleeve of the socket when the connector receptacle is installed thereon. At least one of the legs has a recess and a resilient tubular contact terminal disposed therein and held captive by the walls of the recess. The terminal is slidable onto the central post of the cigar lighter socket. A resilient spring contact finger is carried by the other of the legs and has a bowed body portion extending into the space between the legs. The center of the bowed body portion is cooperable with and juxtaposed to one surface of the annular sleeve of the cigar lighter socket so as to provide a current path when the receptacle is installed. The tubular contact terminal and spring contact finger are generally coextensive with one another, and the force of the sleeve acting against the spring contact finger is balanced by a counteracting force of the central post acting on the tubular contact terminal, thereby to maintain adequate pressure between the contact finger and sleeve.

In another embodiment of the invention, the objects are accomplished by a dual-contact electrical connector receptacle comprising, in combination, a body of molded insulating material with expansive, opposite, exteriorly exposed grip surfaces, and a projecting portion adapted to extend into the space between the walls of the sleeve of the cigar lighter socket when the connector receptacle is installed thereon. The projecting portion has a recess, and a resilient tubular contact terminal is disposed in and held captive by the walls of the recess. The terminal is slidable onto the central post of the cigar lighter socket. A resilient spring contact finger is carried by the projecting portion of the receptacles and has a bowed body extending in a direction radially outwardly of the axis of the contact terminal. The center of the bowed body is adapted for sliding electrical contact with the inner surface of the sleeve of the cigar lighter socket when the receptacle is in place. The tubular contact terminal and spring contact finger are generally coextensive with one another and the force of the sleeve on the spring contact finger is also balanced by a counteracting force of the central post acting on the tubular contact terminal, thereby to maintain adequate pressures between the contact finger and the inner wall of the sleeve.

Other features and advantages will hereinafter appear.

In the drawings, illustrating several embodiments of the invention:

Figure 1:
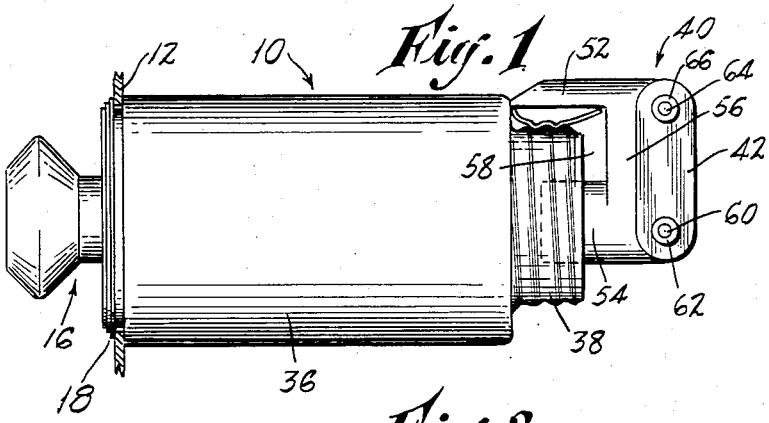
FIG. 1 is a side elevational view, enlarged, of a cigar lighter device shown mounted in a dashboard or panel of an automotive vehicle and incorporating the improved dual-contact electrical connector receptacle of the present invention.
Figure 2:
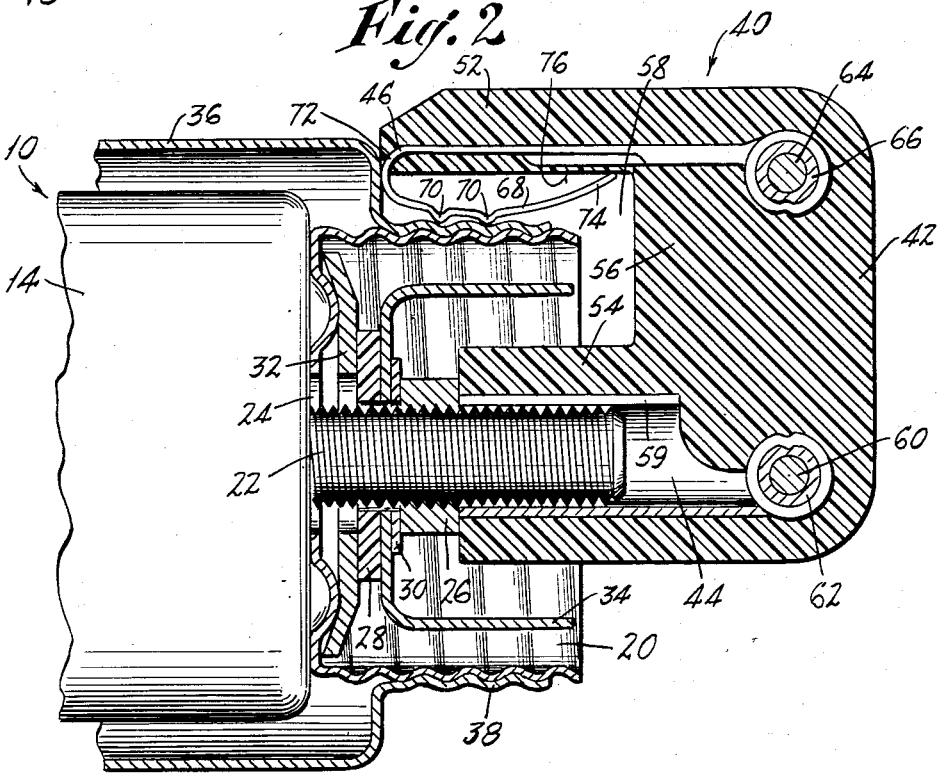
FIG. 2 is a further enlarged view, partly in side elevation and partly in vertical section, of the rear portion of the cigar lighter socket, and showing details of the connector receptacle of FIG. 1.
Figure 3:
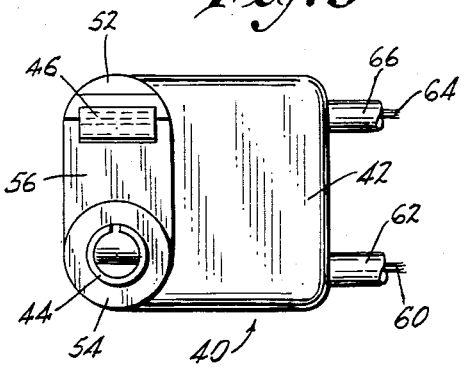
FIG. 3 is an enlarged front elevational view of the connector receptacle of FIG. 1.
Figure 4:
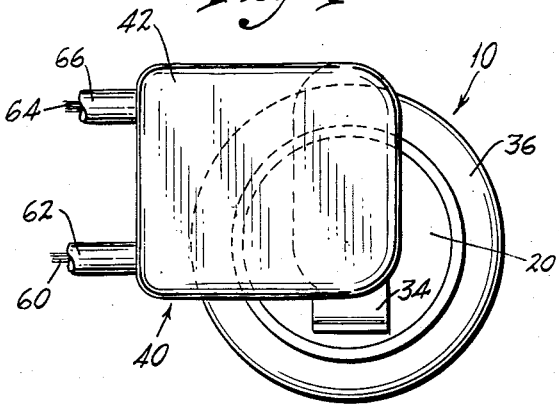
FIG. 4 is an enlarged rear elevational view of the connector receptacle and cigar lighter socket of FIG. 1.

Referring first to FIGS. 1, 2 and 4 there is illustrated a cigar lighter device generally designated by the numeral 10, adapted for installation in an aperture of a dashboard or other panel 12, the device comprising a well or socket 14 which carries an ignitor plug 16, all of conventional construction. The front edge of the socket is curled over at 18 and engages the front surface of the dashboard or panel 12, as shown. The inner end of the socket 14 has an annular sleeve in the form of a threaded screw shell 20 which is secured to supporting portions of the socket 14 and is in electrical contact therewith. Also disposed at the inner end of the socket 14 is a central post 22 constituted as a screw having its head (not shown) located within the cylindrical part of the socket and in electrical contact with bimetallic fingers (also not shown) of the type which are adapted to grip a cup that carries the ignitor plug heating coil, and to release the cup after the coil has reached incandescence. The cylindrical portion of the socket 14 has an aperture in its end, of a size sufficient to provide adequate clearance for the post 22. In addition, as illustrated the screw shell has a similar aligned aperture 24, also of a size that is sufficient to clear the post 22.

The post 22 is secured by a nut 26. Under the nut 26 are washers 28, 30 and a centralizing spacer ring 32 which mount a bimetal overheat strip 34 that functions to intentionally electrically short circuit the socket in the event that a predetermined excessive temperature has been reached. The strip 34 normally occupies the position illustrated when cold, and the legs spread in a radially outward direction, toward the inner surface of the sleeve 20 in the event that excessive heating occurs. Under normal operation, the legs do not come into electrical contact with this inner surface. However, if there occurs a malfunction in the operation of the cigar lighter, as in the case where the circuit through the igniting coil remains closed due to a failure of the bimetal fingers to release the igniting coil cup properly, or due to possible delay in the release, the legs of the strip 34 will spread sufficiently to come into electrical contact with this inner sleeve surface, thus shorting the socket and blowing the fuse in the line supplying power to the lighter. Following this, the strip will automatically reset itself, that is, it will return to the position shown in FIG. 2.

The socket 14 is held in position at the rear of the panel 12 by means of a tubular clamping shell 36 which engages its rear surface. The clamping shell 36 has a rolled thread formation or threaded portion 38 cooperable with the threads of the sleeve 20. That is, during installation the socket 14 is inserted into the aperture of the dashboard from the front, and the clamping shell 36 positioned at the rear and tightened to the desired extent such that the dashboard 12 will be sandwiched between the curl 18 and front circular edge of the clamping shell 36.

In accordance with the present invention and as shown in FIGS. 1–5, there is provided a novel and improved electrical connector receptacle 40 for use with the cigar lighter described above, the receptacle comprising a generally non-tubular slab-like body 42 of molded insulating material such as vinyl or other plastic, and a pair of contacts 44, 46 which respectively engage the central post 22 of the socket and the threaded portion 38 of the clamping shell 36. The body 42 has a pair of expansive, opposite, exteriorly exposed grip surfaces 48, 50, FIG. 5, to facilitate grasping the connector receptacle by the user or installer during initial assembly or replacement of the receptacle. By the present invention, the body 42 has a U-shaped portion with two legs 52, 54 and a connecting web or yoke 56. There is thus defined a space 58 between the legs 52, 54 which provides clearance for the sleeve 20, threaded portion 38 and bimetal strip 34 when the receptacle is installed. The contact 44 is in the form of a split tubular structure having a longitudinal slit 59, and is resilient such that it can be sprung slightly as it is slipped over the post 22 so as to physically grip it, and establish good electrical contact therewith. This tube or contact 44 is connected to an external lead 60 having conventional vinyl insulation 62 and extending to the "hot" side of the vehicle's electrical system through suitable fusing (not shown). The remaining contact 46 is connected to another external lead 64 having insulation 66, the lead extending to the vehicle's ground. As shown, both contacts 44 and 46 are molded in the body 42 of the connector receptacle, and remain embedded therein after the molded part cures sufficiently.

By the present invention, the contact 46 has a bowed central portion 68 which is generally coextensive and cooperable with, and physically juxtaposed to the wall of the sleeve 20. The portion 68 makes electrical contact to the sleeve 20 through physical and electrical engagement with the outer surface of the threaded portion 38 of the clamping shell 36. During installation, the bowed portion 68 is sprung slightly in a radially outward direction by the pressure of the threaded portion of the sleeve 20. Thus, there exists a force applied by this threaded portion of the sleeve 20, through the threaded portion 38 of the clamping shell 36 and against the contact finger 46, this force being counteracted by an opposite force of the post 22 acting on the lower wall of the tubular contact 44 in FIG. 2. Such an arrangement has been found to provide the necessary contact pressures to minimize voltage drops which would normally be encountered when dealing with separable-type connectors for high current devices such as automobile electric cigar lighters of this kind.

Further, by the present invention, the contact finger 46 has one or more nibs 70 constituted as small projections on the inner surface of the finger, receivable in one or more of the grooves of the threaded portion 38. One nib 70 may be employed, or alternately two or more provided, in which latter case the spacing between adjacent nibs 70 would preferably be the same as the pitch of the threaded portion, such that the nibs would occupy adjacent grooves. This construction has the advantage that there occurs, during installation or removal of the receptacle, a desired wiping and detent "feel" or action between the surfaces of the nibs and the peaks of the threaded portion 38, such action tending also to scrape away residual oxidation and improve the electrical connection between the two parts.

Also, in accordance with the invention, the contact finger 46 has a curved cross section 72 in the area adjacent the end of the leg 52, this providing a lead-in formation which facilitates installation of the connector receptacle. Additionally, the end 74 of the spring contact finger is freely movable, and the inner surface 76 of the leg 52 is relatively smooth so as to permit limited sliding of this end 74 over the surface as the receptacle is installed, as would occur when the contact finger 46 was compressed slightly in a radially outward direction.

The above construction has the following advantages which are not found in prior connectors for cigar lighters. The present arrangement effectively overcomes problems involving loosening of spade lug type terminals, or inadvertent failure to properly install such devices initially. In the disclosed device, the receptacle is essentially a unitary assemblage, and thus installation is greatly simplified since but a single operation is required as opposed to two distinct operations, involving two separate connectors. Integrity of the electrical connections is preserved, because there is little or no tendency for the contact finger 46 to be sprung if there occurs repeated installation or removal. This problem sometimes arises with spade-type connectors. Also, in the present instance, the contacts 44, 46 are mostly completely concealed by and protected against damage from outside the connector. This is considered important, since in automated assembly lines, breakage of a component causes back-ups and resultant delays. Also, there are minimized irregularities which might occur relating to operator related error, or misjudgement on the part of the installer or assembly line worker.

Finally, the disclosed construction is seen to be physically small. The receptacle body extends only slightly beyond the cylindrical surface of the clamping shell. Accordingly, a minimum of space is required. This feature is significant for applications in the newer model vehicles where compactness is an important consideration. Also, accessibility to the lighter device is improved through the use of physically small components.

Moreover, the present construction does not interfere with operation of the bimetal overheat strip 34, since the space 58 between the legs 52, 54 provides the necessary clearance. In the event that the clamping shell 36 is eliminated, as where the socket is mounted by alternate means, the same receptacle can still be employed without modification, since under such circumstances the contact finger 46 will merely engage the outer surface of the sleeve 20 directly, as opposed to the disclosed arrangement wherein it engages the outer surface of the threaded portion of the clamping shell 36. In the case where the sleeve has sufficient axial length, this engagement by the contact finger 46 can be with either the inner or the outer surface of the shell 20, as will be explained below.

Figure 5:
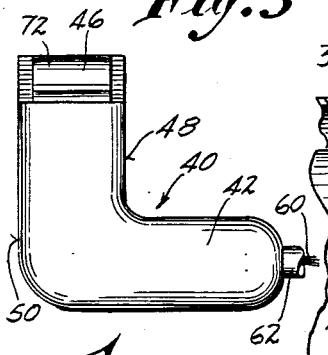
FIG. 5 is an enlarged bottom plan view of the connector receptacle.
Figure 6:
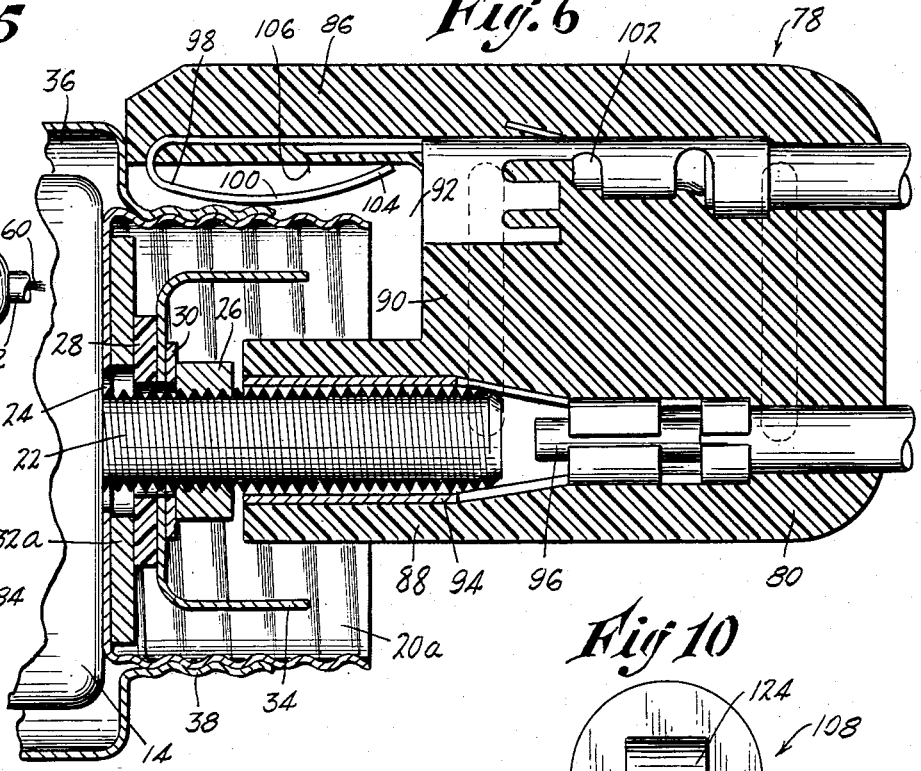
FIG. 6 is a greatly enlarged view, partly in side elevation and partly in vertical section, of a cigar lighter socket of slightly different construction, and a somewhat modified connector receptacle, constituting another embodiment of the invention.
Figure 7:
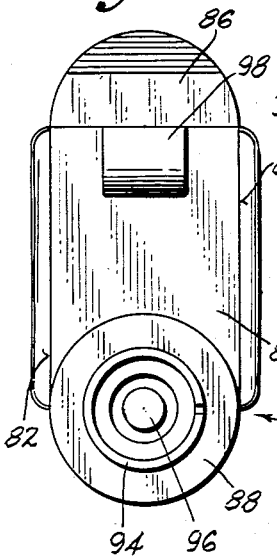
FIG. 7 is an enlarged front elevation of the connector receptacle of FIG. 6.
Figure 8:
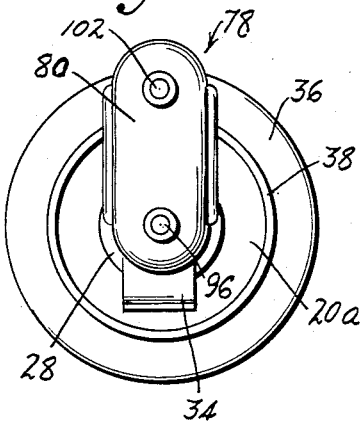
FIG. 8 is an enlarged rear elevation of the receptacle and socket of FIG. 6.

Another embodiment of the invention is shown in FIGS. 6–8 wherein like reference numerals indicate parts similar to those of the embodiment of FIGS. 1–5. The cigar lighter socket 14 carries at its inner end a slightly modified annular screw shell or sleeve 20*a*. A central terminal post 22 extends from the interior of the socket 14, through an aperture 24 in the sleeve which is aligned with apertures in a spacer ring 32*a* and washers 28, 30, the latter two parts sandwiching a bimetal overheat strip 34. A nut 26 completes the assembly.

The socket 14 is mounted on a dashboard or panel similar to that indicated 12 in FIG. 1, by means of a clamping shell 36 having a threaded portion 38 which cooperates with a corresponding threaded portion of the sleeve 20*a*.

By the present invention there is provided an improved connector receptacle 78 for installation on the socket 14, the unit comprising a substantially flat, non-tubular molded body 80 having expansive opposite surfaces 82, 84 (FIG. 7) by which the receptacle can be grasped, and having a generally U-shaped configuration, as shown in FIG. 6. The body has a pair of legs 86, 88 and a connecting web or yoke portion 90, the legs defining a space 92 which provides clearance for the sleeve 20*a* when the receptacle is installed. The leg 88 has a recess in which there is embedded a contact in the form of a split tubular structure 94 to which there is connected an electrical lead 96 that projects from the rear edge of the receptacle and is adapted to be connected to the "hot" side of the vehicle's electrical system. Disposed in the other leg 86 is a second contact 98 in the form of a spring finger having a central bowed portion 100 that is cooperable with and juxtaposed to the sleeve 20*a*. The portion 100 is adapted for electrical connection with the sleeve 20*a*, through the clamping shell threaded portion 38. Extending from the contact 98 is an electrical lead 102 that is embedded in the receptacle body, and which projects from the rear edge thereof for connection with the vehicle's electrical ground. As in the previous embodiment, the contact 98 has a curved cross section at the point where it emerges from the leg 86, providing a lead-in formation for the bowed portion 100 as the receptacle is installed on the socket. Also, the end of the contact, indicated 104, is free, and can slide a limited extend on a smooth inner wall 106 of the leg 86 when the central portion 100 is biased in a radially outward direction, as during compression by the sleeve 20*a* and threaded portion 38 of the clamping shell 36.

The embodiment of FIGS. 6–8 involves a connector receptacle whose electrical leads are intended to project from the rear of the receptacle, this being known generally as a "straight on"-type connector. The first embodiment, FIGS. 1–5, involved a construction wherein the molded body 42 had a right angle bend, as shown in FIG. 5, such that the leads 60, 64 thereof would be disposed generally perpendicular to the axis of the socket and clamping shell. Space considerations would dictate which arrangement would be applicable to a particular installation. In other respects, the operation of the two constructions is essentially the same.

Figure 10:
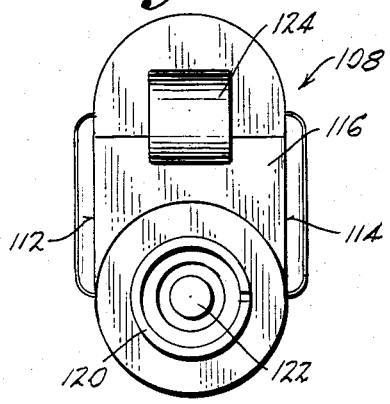
FIG. 10 is an enlarged front elevation of the connector receptacle of FIG. 9.
Figure 9:
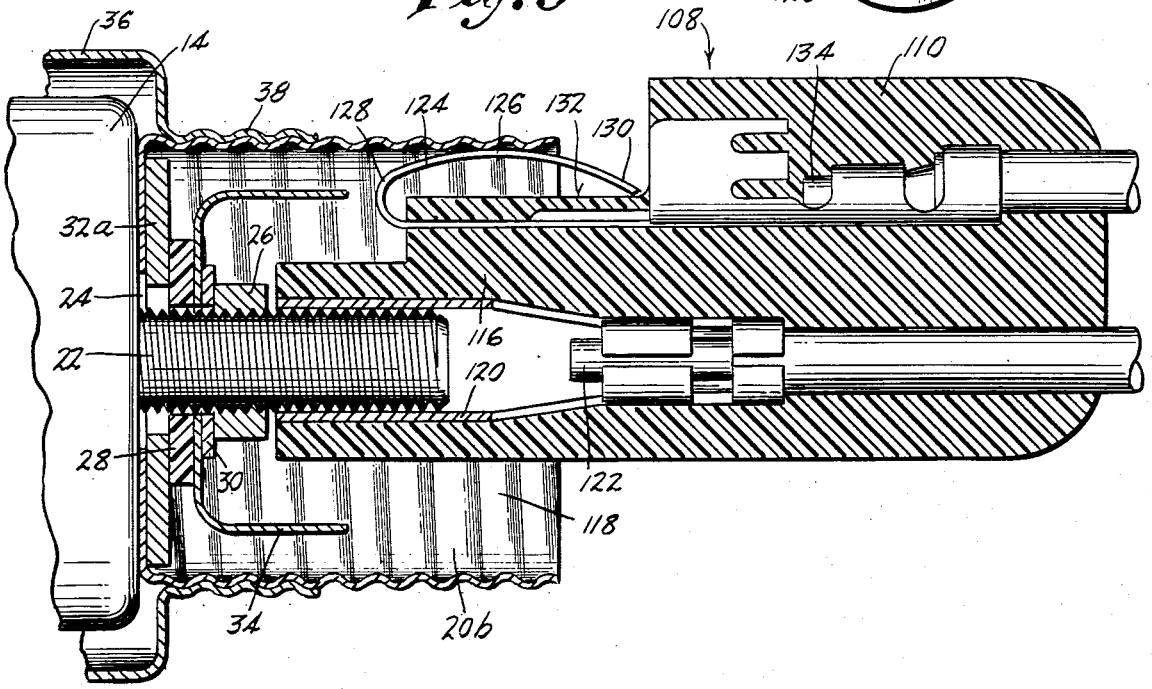
FIG. 9 is a greatly enlarged view, partly in side elevation and partly in vertical section, of a further modified cigar lighter socket incorporating an elongate threaded base sleeve or shell, and a further modified connector receptacle cooperable therewith, constituting still another embodiment of the invention.
Figure 11:
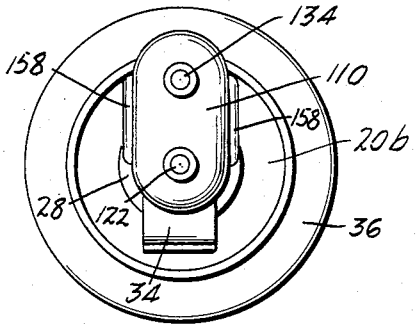
FIG. 11 is an enlarged rear elevation of the socket and receptacle of FIG. 9.

Still another embodiment of the invention is shown in FIGS. 9–11. Reference numerals similar to those of the construction illustrated in the first embodiment have been assigned to the corresponding parts of the present arrangement. At the inner end of the cigar lighter socket 14 of FIG. 9 is a screw shell or annular sleeve 20*b* of somewhat modified construction in that the length of the sleeve is greater than that shown in FIG. 2 or 6. The central terminal post 22 extends through the opening 24 in the sleeve 20*b*, with washers 28, 30, spacer 32*a*, and nut 26 being carried thereon. The bimetal overheat strip 34 is disposed within the sleeve, as before.

By the present invention, there is provided a modified connector receptacle 108 comprising a molded body 110 constituted of insulating material such as vinyl or other plastic or plastic-like substance, having opposite expansive surfaces 112, 114 by which the body can be grasped, as during installation, and further having a projecting portion 116 which is capable of extending into the space 118 between the walls of the sleeve 20*b*. The projecting portion 116 has a recess in which there is disposed a split tubular contact 120 connected with an electrical lead 122 emerging from the end of the receptacle, as shown. Also carried on the projecting portion is a second contact 124 in the form of a resilient spring finger having a central bowed portion 126 which is adapted for direct engagement with the inner surface of the annular wall of the sleeve 20*b*. The finger 124 has a curved cross-section at 128, constituting a lead-in which can engage the edge of the sleeve 20*b* as the connector receptacle is installed. The end 130 of the finger is free, and can slide a limited extent over the smooth surface 132 of the body as the bowed portion 126 is biased in a radially inward direction under the action of the sleeve 20*b*. Connected to the contact 124 is an electrical lead 134 extending to the vehicle's electrical ground.

The construction of FIGS. 9–11 has the advantage of small physical size, since it can be seen that the body of the receptacle 108 does not extend laterally past the theoretical cylindrical surface formed by the clamping shell 36. This particular construction may be especially applicable for installations where adequate space may not be available for one of the other arrangements illustrated above, or where accessibility to the rear of the socket is limited.

Figure 12:
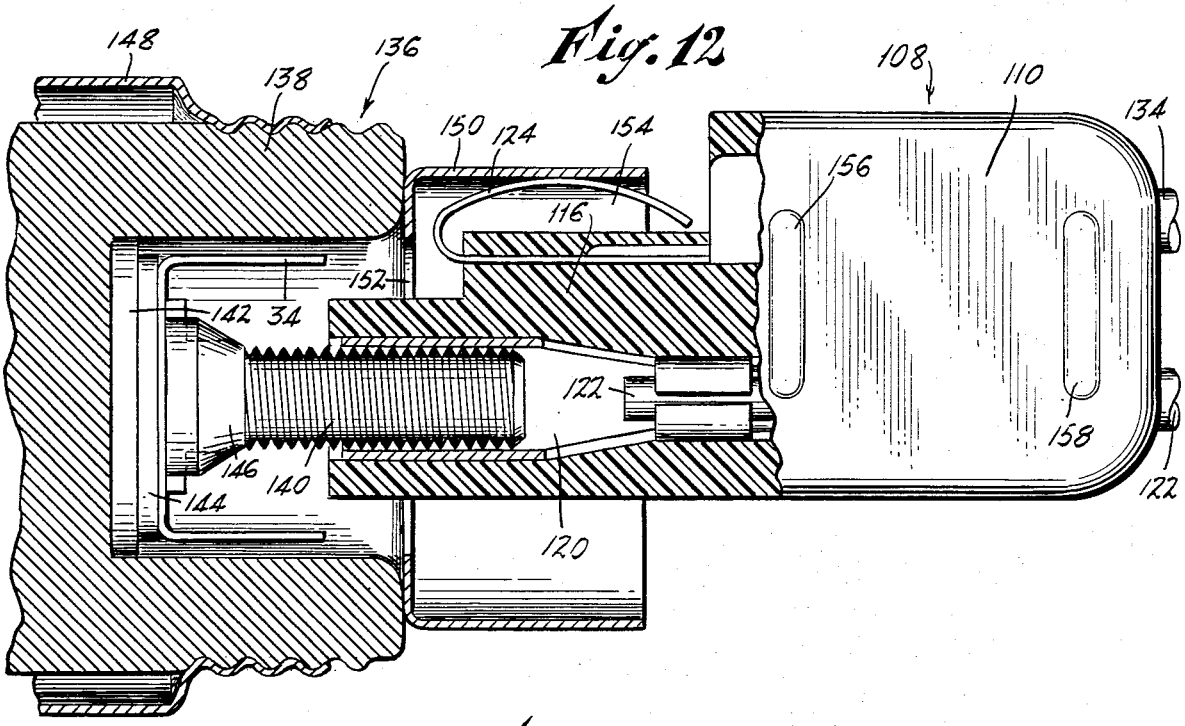
FIG. 12 is a greatly enlarged view, partly in side elevation and partly in vertical section, of a still further modified socket and the connector receptacle of FIG. 9, constituting yet another embodiment of the invention.

Still another embodiment of the invention is illustrated in FIG. 12, wherein a modified socket 136 is shown, having a base 138 that forms a recess in which a central terminal post 140 is disposed. The post 140 is insulated from the base 138 by a spacer washer 142, and a bimetal overheat strip 34 is sandwiched between a washer 144 and member or collar 146 that is shear-staked to the post 140. The socket 138 is mounted at the rear of a panel or dashboard (not shown) by a clamping shell 148. Welded to the socket 138 is an annular or cylindrical sleeve 150 having a centrally disposed end opening 152.

By the present invention, the connector receptacle 108 illustrated in FIG. 9 is applicable to the modified socket construction of FIG. 12, and like reference numerals in this latter figure designate components similar to those of FIG. 9. The terminals of the receptacle are indicated 120 and 124, respectively, with the electrical supply leads being labelled 122 and 134, the latter being the electrical ground side of the circuit. By the invention, the contact 124 directly engages the smooth inner wall surface 154 of the sleeve 150, thus establishing electrical contact therewith. The remaining contact 120 is adapted to slip over the central terminal post 140, this constituting the "hot" leg of the lighter circuit. Particularly illustrated in FIG. 12 are transverse raised ribs 156, 158 which facilitate grasping the receptacle. Similar ribs are incorporated on the receptacle 78 of FIGS. 6–8, and on that of FIGS. 9–10, but labelling of them in those figures has been omitted for purposes of clarity. Installation of the receptacle of FIG. 12 is accomplished by merely pushing it onto the socket in an axially forward direction, from the socket rear, as in the prior constructions.

Figure 13:
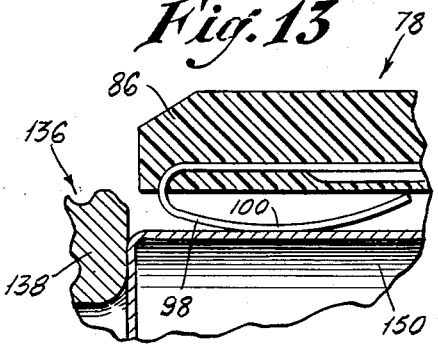
FIG. 13 is an enlarged fragmentary section of yet another socket construction and the receptacle of FIG. 6, constituting yet another embodiment of the invention.

Still another embodiment is shown in FIG. 13. The receptacle 78 is substantially identical to that shown in FIG. 6, having the contact 98 carried on the leg 86. The socket 136 is identical to that of FIG. 12, as is the annular sleeve. By the invention, the bowed central portion 100 is slidingly engageable with the smooth outer surface of the sleeve 150, so as to establish a good electrical contact therewith. In other respects this construction is similar to that of FIG. 12.

The embodiments disclosed in FIGS. 6–8, 9–11, 12 and 13 respectively have the same advantages noted above in connection with the discussion of the first mentioned embodiment, FIGS. 1–5, namely simplicity, ease of installation, and freedom from malfunction over extended periods of use. The contact pressures between the socket and the spring contact finger of the receptacle are sufficient to carry the considerable current drawn by such lighter devices, without encountering problems with excessive voltage drops, contact heating, deterioration in the integrity of the electrical connection, etc.

In all of the above constructions, the contact or split tubular structures (as indicated at 44 in FIG. 2, for example), preferably include an inwardly-extending dimple or detent (not shown in the figures), for engagement with adjacent peaks of the threaded post (22), so as to improve the electrical contact therewith and better retain the receptacle 40. These detents form no part of the present invention, however.

The various embodments that have been disclosed are thus seen to represent a distinct advance and improvement in the electric cigar lighter field.

Each and every one of the appended claims defines an aspect of the invention which is distinct from all others, and accordingly each claim is to be treated in this manner when examined in the light of the prior art in any determination of novelty or validity.

Variations and modifications are possible without departing from the spirit of the claims.

What is claimed is:

1. A dual-contact electrical connector receptacle for bringing current to an automotive vehicle's electric cigar lighter, said lighter being of the type having an ignitor-plug receiving socket with an annular electrically-conductive current-carrying sleeve at its inner end, said sleeve being electrically connected to the ground side of the cigar lighter circuit, said socket further having a central terminal post connected to the hot side of the cigar lighter circuit, the receptacle comprising in combination:

(a) a non-tubular, slab-like body of molded insulating material, (b) said body having a pair of expansive, opposite, exteriorly exposed grip surfaces to facilitate manual engagement by an installer, (c) said body comprising a U-shaped portion having two legs and a connecting yoke, the space between said legs providing clearance for said annular sleeve of the cigar lighter socket when the connector receptacle is installed thereon, (d) at least one of said legs having a recess, (e) a resilient tubular contact terminal disposed in and held captive by the walls of the recess, said terminal being slidable onto the central terminal post of the cigar lighter socket, (f) a resilient spring contact finger carried by the other of said legs and having a bowed body portion extending into said space between the legs, the center of the bowed body portion being cooperable with and closely juxtaposed to one surface of the annular sleeve of the cigar lighter socket, and being adapted to provide a current path thereto when the receptacle is installed thereon, and (g) a pair of electrical leads connected respectively with said tubular contact terminal and said spring contact finger, for connection to the vehicle's electrical system, (h) said tubular contact terminal and spring contact finger being generally coextensive with one another and the force of the sleeve acting against the spring contact finger being balanced by a counteracting force of the central post acting on the tubular contact terminal, thereby to maintain adequate pressure between the contact finger and sleeve.

2. The invention as set forth in claim 1, wherein:

(a) substantially all portions of the spring contact finger lie radially within the confines of the said other leg of the connector body, said other leg constituting a shield in order to protect the spring contact finger against inadvertent damage.

3. The invention as set forth in claim 1, wherein:

(a) the spring contact finger directly engages an outer surface of said sleeve.

4. The invention as set forth in claim 1, wherein:

(a) the spring contact finger directly engages an inner surface of said sleeve.

5. The invention as set forth in claim 1, wherein:

(a) said socket carries an overheat switch comprising a bimetallic strip having two oppositely disposed legs, said strip being electrically connected to said central terminal post and disposed within said sleeve, (b) the space between the legs of the receptacle body providing clearance for one leg of the bimetallic switch when the receptacle is installed on the socket such that there is no interference between the switch and the receptacle body.

6. The invention as set forth in claim 1, wherein:

(a) said annular sleeve is threaded, and (b) a tubular clamping shell of generally cylindrical configuration, having a threaded portion of reduced diameter, cooperable with and electrically engaging the outer surface of the threaded sleeve, (c) said spring contact finger directly engaging the outer surface of the clamping shell threaded portion.

7. The invention as set forth in claim 6, wherein:

(a) said clamping shell threaded portion comprises a rolled thread formation, (b) said thread formation being characterized by alternate peaks and grooves, (c) the spring contact finger having a nib adapted to occupy one of the grooves of the thread formation and facilitate seating thereof, thereby improving the electrical contact between the two parts.

8. The invention as set forth in claim 6, wherein:

(a) said clamping shell threaded portion comprises a rolled thread formation, (b) said thread formation being characterized by alternate peaks and grooves, (c) the spring contact finger having multiple nibs adapted to occupy the grooves of the thread formation and facilitate seating thereof, thereby improving the electrical contact between the two parts.

9. The invention as set forth in claim 8, wherein:

(a) the distance between the nibs is substantially equal to the pitch of the thread formation.

10. The invention as set forth in claim 1, wherein:

(a) one end of the bowed body portion of the spring contact finger is characterized by a curved cross section, thereby providing a lead-in formation for the contact finger as it comes into engagement with the sleeve, during installation of the connector receptacle.

11. The invention as set forth in claim 10, wherein:

(a) the other end of the bowed body portion is free, (b) said free end being slidingly engageable with the inner surface of one leg of the connector receptacle in response to radially outward biasing of the center of the bowed body portion of the contact finger, resulting from its engagement with the said sleeve.

12. A dual-contact electrical connector receptacle for bringing current to an automotive vehicle's electric cigar lighter, the lighter being of the type having an ignitor-plug receiving socket with an annular electrically conductive, current-carrying sleeve at its inner end, said sleeve being electrically connected to the ground side of the cigar lighter circuit, said socket further having a central terminal post connected to the hot side of the cigar lighter circuit, the receptacle comprising in combination:

(a) a body of molded insulating material, (b) said body having a pair of expansive, opposite, exteriorly exposed grip surfaces to facilitate manual engagement by an installer, (c) said body comprising a projecting portion adapted to extend into the space between the walls of the sleeve of the cigar lighter socket when the connector receptacle is installed on the socket, (d) said projecting portion having a recess, (e) a resilient tubular contact terminal disposed in and held captive by the walls of the recess, said terminal being slidable onto the central terminal post of the cigar lighter socket, (f) a resilient spring contact finger carried by the projecting portion and having a bowed body portion extending in a direction radially outwardly of the axis of the contact terminal, the center of the bowed body portion being adapted for sliding electrical contact with the inner surface of the sleeve of the cigar lighter socket when the receptacle is installed thereon, and (g) a pair of electrical leads connected respectively with said tubular contact terminal and said spring contact finger, for connection to the vehicle's electrical system, (h) said tubular contact terminal and spring contact finger being generally coextensive with one another and the force of the sleeve on the spring contact finger being balanced by a counteracting force of the central terminal post acting on the tubular contact terminal, thereby to maintain adequate pressure between the contact finger and the inner wall of the sleeve.

13. The invention as set forth in claim 12, wherein:

(a) said annular sleeve is of substantially a cylindrical configuration, with a generally smooth side wall, (b) said spring contact finger directly engaging and electrically contacting the inner surface of the side wall.

14. The invention as set forth in claim 12, wherein:

(a) said annular sleeve is of substantially cylindrical configuration, with a threaded side wall, (b) said spring contact finger directly engaging and electrically contacting the inner surface of the side wall.

15. The invention as set forth in claim 12, wherein:

(a) one end of the bowed body portion of the spring contact finger is characterized by a curved cross section, thereby providing a lead-in formation for the contact finger as it comes into engagement with the sleeve, during installation of the connector receptacle.

16. The invention as set forth in claim 15, wherein:

(a) the other end of the bowed body portion is free, (b) said free end being slidingly engageable with the outer surface of one leg of the connector receptacle in response to radially inward biasing of the center of the bowed body portion of the contact finger, resulting from its engagement with the said sleeve.

* * * * *